United States Patent [19]

Fisher et al.

[11] 4,344,483

[45] Aug. 17, 1982

[54] MULTIPLE-SITE UNDERGROUND MAGNETIC HEATING OF HYDROCARBONS

[76] Inventors: Charles B. Fisher, 2850 Hill Park Rd., Montreal, Quebec, Canada, H3H 1T1; Sidney T. Fisher, 53 Morrison Ave., Montreal, Quebec, Canada, H3R 1K3

[21] Appl. No.: 300,188

[22] Filed: Sep. 8, 1981

[51] Int. Cl.[3] ..... E21B 43/24; E21B 43/243

[52] U.S. Cl. ..... 166/248; 166/64; 166/65 M; 166/261; 166/258

[58] Field of Search ..... 166/248, 272, 256, 261, 166/258, 60, 65 M, 64

[56] References Cited

U.S. PATENT DOCUMENTS

| | | | |
|---|---|---|---|
| 2,584,605 | 2/1952 | Merriam et al. | 166/258 X |
| 3,294,167 | 12/1966 | Vogel | 166/258 X |
| 3,809,159 | 5/1974 | Young et al. | 166/258 |
| 3,946,809 | 3/1976 | Hagedorn | 166/248 |
| 3,989,107 | 11/1976 | Fisher et al. | 166/248 |
| 4,043,393 | 8/1977 | Fisher et al. | 166/248 |

OTHER PUBLICATIONS

Fisher et al., "Induction Heating Feasible for In Situ Processing", Oil & Gas Journal, Aug. 1, 1977, pp. 94–97.

*Primary Examiner*—Stephen J. Novosad

[57] ABSTRACT

A first underground deposit of lignite or coal is heated by magnetic induction to recover hydrocarbon liquids and gases. The carbon remaining is combusted with air and steam to produce a gas which is combusted to generate electrical energy. The electrical energy is transmitted to second underground deposits of oil shale, tar sand or heavy oil, and is used to heat the second deposits in order to recover hydrocarbon liquids and gases.

8 Claims, 2 Drawing Figures

MULTIPLE-SITE UNDERGROUND MAGNETIC HEATING OF HYDROCARBONS

BACKGROUND OF THE INVENTION

This invention discloses the method of heating a part of a first underground deposit of coal or lignite by magnetic induction under controlled temperature and pressure, to recover hydrocarbon fluids, with subsequent combustion of the remaining carbon and air and steam to produce a combustible gas used to generate electrical power. The electrical power is partly used to heat another part of the first deposit from which hydrocarbon fluids have been recovered, and is partly transmitted to second underground deposits of oil shale, tar sand or heavy ol, where it is used to heat the second deposits by magnetic induction, under controlled temperatures and pressures, to recover hydrocarbons in fluid form.

In the prior art the multiple-site operation described above does not use controlled temperatures and pressures at each deposit.

SUMMARY OF THE INVENTION

A first underground deposit, of lignite or coal, has a conducting liquid injected, and is then heated by magnetic induction to generate hydrocarbon fluids. The rate of escape of these fluids, and of heating, is controlled to keep the temperature of the deposit above the pyrolysis and recovery temperature of the hydrocarbons, but below the pressure at which the fluids break through the overlying strata.

After a portion of the deposit has been heated adequately to deliver substantially all its hydrocarbon fluids to the surface, steam and air are injected into the remaining carbon which is combusted to produce a combustible gas. This gas is burned at the surface to generate electricity, a part of which is used to heat another portion of the deposit, and a part of which is transmitted to at least one second underground deposit of oil shale, tar sand or heavy oil. A conducting solution is injected into the part of the second deposit to be heated, which is then heated by a magnetic field generated by the electricity from the first deposit. The rate of escape of hydrocarbon fluids and steam from the second deposit to the surface, and the rate of magnetic induction heating, are controlled to maintain the deposit at a temperature adequate to cause pyrolysis and recovery of the hydrocarbons in the deposit, but at a pressure below the pressure at which the fluids break through the overlying strata.

DETAILED DESCRIPTION OF THE INVENTION

The invention comprises the method of magnetic induction heating on a first site of a portion of a first underground deposit of lignite or coal, recovering hydrocarbon fluids under conditions of controlled temperature and pressure, combusting the remaining carbon with water or steam, and using the combustible gas so produced and recovered to generate electricity. Part of the electricity is used to heat another part of the first deposit, and part is transmitted to one or more sites where there is a second underground deposit of oil shale, tar sand or heavy oil. The electricity transmitted to the second site is used to heat at least a portion of the second deposit under conditions of controlled temperature and pressure, in order to recover the hydrocarbons as fluids from the second site.

Figure 1:
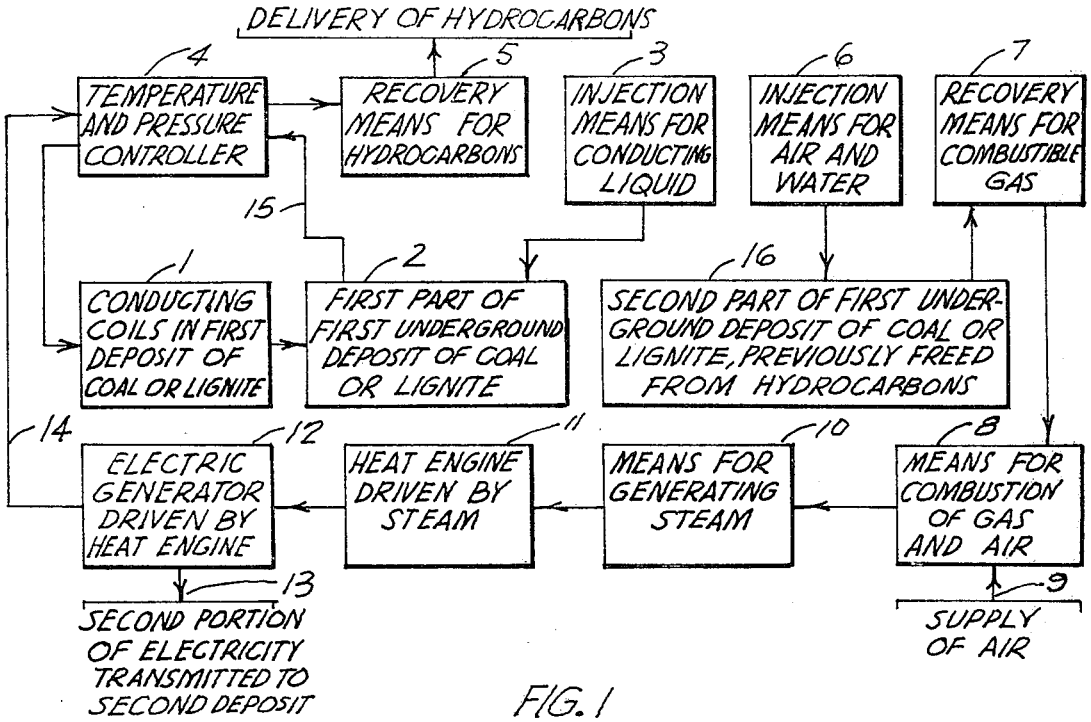
FIG. 1 shows diagrammatically the processes according to the invention at a first site containing a first underground deposit of coal or lignite.

FIG. 1 shows diagrammatically the method of the invention at an underground coal or lignite deposit, which produces hydrocarbon fluids and electricity.

A coil 1 of electric conductors is constructed to enclose a first portion 2 of an underground deposit of coal or lignite. In order to increase the electrical conductivity of portion 2 of the deposit, surface injection means 3 injects into it a conducting liquid, such as a solution of common salt in water. Electrical energy delivered over lead 14 is then passed through controller 4 to coil 1 and heats portion 2 by magnetic induction. This causes a rise in temperature, with increase in pressure. The temperature is allowed to rise above the point at which pyrolysis, or conversion of the solid hydrocarbons in the coal or lignite, is well advanced. The hydrocarbon fluids and steam generated, which pass to the surface through duct 15, cause an increase in pressure in the deposit, are maintained at a value lower than the pressure sufficient to break through the overlying strata, and at an adequate temperature, by temperature and pressure controller 4, which adjusts the heating rate and releases hydrocarbon fluids and steam to recovery means 5 for hydrocarbon fluids. These fluids may be separated here, for instance the methane may be drawn off and the other fluids converted and refined to the hydrocarbon compounds which are desired.

After the hydrocarbons underground have been recovered by a factor of some 85 to 95%, the electric current in the coil is discontinued and the underground hydrocarbon fluids and steam are released to atmospheric pressure.

While first portion 2 of the deposit is producing hydrocarbon fluids, second portion 16, which has previously delivered its hydrocarbons, has air, with water or steam, injected by means 6 from the surface, and the underground carbon remaining from the coal is ignited. This produces a gas, mainly carbon monoxide, methane and hydrogen, with a relatively low calorific value, which is brought to the surface by recovery means 7, and combusted with air from air supply 9 in combustion means 8. The heat from combustion means 8 is used to produce steam in steam generator 10, which drives heat engine 11, and produces electricity from the coupled electricity generator 12.

Figure 2:
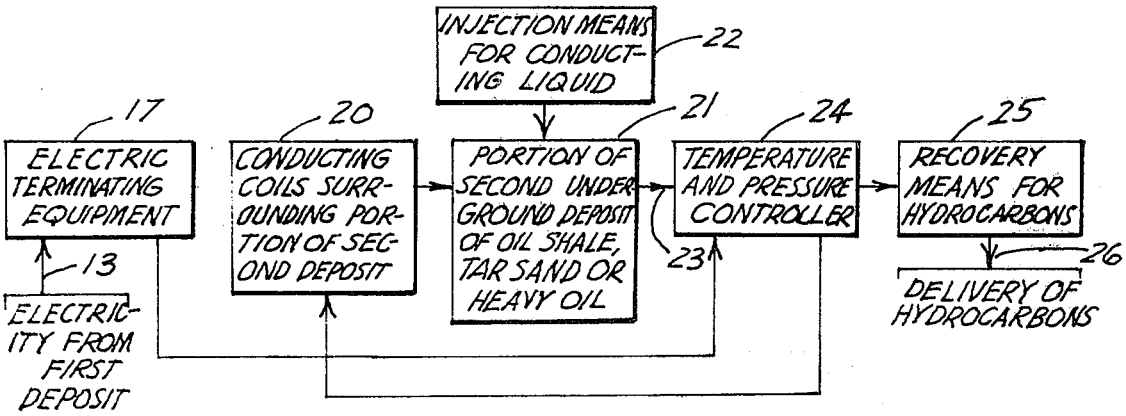
FIG. 2 shows diagrammatically the processes according to the invention at a second site, containing a second underground deposit, of oil shale, tar sand or heavy oil.

A portion of the electricity produced is delivered over line 14 to coil 1 through controller 4, or to another part of the first deposit, and the balance is delivered over line 13 to a second site, shown in FIG. 2, which has a second underground deposit of oil shale, tar sand of heavy oil.

At the first site, shown in FIG. 1, in realistic estimates the value of the hydrocarbons delivered by recovery means 5 is substantially greater than the total operating cost and financial burden of the first site, and the major portion of the electricity produced is available for transmission to the second site.

Transmission of electricity to the second site, if distant more than a few miles, is preferably carried over high-voltage direct-current transmission means, converted to square-wave alternating current at the second site, which produces hydrocarbons from an underground deposit of oil shale, tar sand or heavy oil and is controlled by controller 24.

A coil 20 of electric conductors is constructed to enclose a portion 21 of the second underground deposit. In order to increase the electrical conductivity of portion 21 of the deposit, surface injection means 22 injects into it a conducting liquid, such as a solution of common salt in water. Electrical current from line 13 from the first site is delivered to electric terminating equipment 17 and controller 24 which delivers a fluctuating electric current to coil 20. This current heats portion 21 of the underground deposit by magnetic induction.

This causes an underground rise in temperature with increase in pressure. The temperature is allowed to rise above the point at which pyrolysis of the hydrocarbons in the deposit is well advanced. The hydrocarbon fluids cause an increase in pressure in the deposit, which is maintained at a value lower than the pressure sufficient to break through the overlying strata, and at an adequate temperature, by temperature and pressure controller 24, which adjusts the heating rate and releases hydrocarbon fluids and steam generated in the deposit, which pass to the surface through duct 23, at a value lower than the pressure sufficient to break through the overlying strata, and at an adequate temperature, to recovery means 25 for hydrocarbon fluids. Recovery means 25 may deliver hydrocarbons over output means 26.

We claim:

1. The method of producing hydrocarbon fluids from a part of one or more second underground deposits of hydrocarbons with a relatively small proportion of uncombined carbon, which comprises:

injecting a conducting liquid into a first part of a first underground deposit of hydrocarbons with a substantial proportion of uncombined carbon, and heating said first part of said first deposit by a varying magnetic field, under conditions of controlled pressure and temperature, and recovering substantially all fluid hydrocarbons present in and released from said first part of said deposit by said heating by said varying magnetic field, and injecting air and water into a second part of said first deposit from which substantially all hydrocarbon fluids have been previously recovered by the method of this claim, and combusting said air injected into said second part of said first deposit with substantially all of said uncombined carbon, in the presence of steam, so as to produce and deliver to the surface a combustible gas, and combusting said combustible gas with air to generate electricity, and using a first portion of said electricity to heat said first part of said first deposit by magnetic induction, and transmitting a second portion of said electricity to one or more of said second deposits of hydrocarbons, and using said second portion of said electricity to generate a varying magnetic field in at least a part of one of said second deposits of hydrocarbons, and injecting a conducting liquid into said part of said second deposits subjected to said varying magnetic field, and heating said part of said second deposits subjected to said varying magnetic field, under conditions of controlled pressure and temperature, and recovering at the earth's surface said fluid hydrocarbons released by said magnetic heating of said part of said second deposits.

2. The method of producing liquid and gaseous hydrocarbons according to claim 1 in which said conducting liquid is an aqueous solution of a metallic salt.

3. The method of producing fluid hydrocarbons according to claim 1, in which the temperatures in said first part of said first deposit and in said part of said second deposits are controlled by variation of the intensity of each of said magnetic fields to values which ensure substantially complete conversion to fluid forms of said hydrocarbons contained in each of said deposits.

4. The method of producing fluid hydrocarbons according to claim 1, in which the pressures in each of said first part of said first deposit and in said second deposits are controlled by separate pressure controllers at each of said deposits, which limit the pressure in each of said deposits to a value less than the pressure which causes a substantial break-out through strata overlying each of said deposits.

5. The method of producing fluid hydrocarbons according to claim 1, in which said injected water is in the form of steam.

6. The method of producing fluid hydrocarbons according to claim 1, in which said second portion of said electrical energy generated from said first hydrocarbon and carbon deposit is transmitted to said second hydrocarbon deposits by means of a high-voltage direct-current transmission line.

7. The method of producing fluid hydrocarbons according to claim 1, in which said combustion of said carbon in said first part of said first deposit continues until not more than 15% of said uncombined carbon in said first part of said first deposit remains underground.

8. The method of producing fluid hydrocarbons according to claim 1, in which said first deposit is principally composed of one of the following:

lignite,
semi-bituminous coal,
bituminous coal,
anthracite, and said second deposits are principally composed of one of the following:

oil shale,
tar sand,
heavy oil.

* * * * *